United States Patent [19]

Jordan

[11] 3,964,195

[45] June 22, 1976

[54] EVENT CALENDAR

[76] Inventor: Mary Ann McClurkin Jordan, 2165 Fern Dell Place, Los Angeles, Calif. 90068

[22] Filed: Apr. 25, 1975

[21] Appl. No.: 571,807

[52] U.S. Cl. ..... 40/107; 283/2
[51] Int. Cl.[2] ..... G09D 3/00
[58] Field of Search ..... 40/107, 119, 121; 283/1 A, 2, 3, 4

[56] References Cited

UNITED STATES PATENTS

| | | | |
|---|---|---|---|
| 1,443,520 | 1/1923 | Beckett | 283/2 |
| 1,597,280 | 8/1926 | Machauer | 283/2 |

*Primary Examiner*—Louis G. Mancene
*Assistant Examiner*—John H. Wolff
*Attorney, Agent, or Firm*—William H. Pavitt, Jr.

[57] ABSTRACT

A single and/or continuing event calendar which particularly lends itself to computer print-out. The calendar is in the form of defined rectangular spaces arrayed in the manner of a conventional monthly calendar with the definition of the spaces accomplished both vertically and horizontally by a series of dash lines spaced from each other, but with the horizontal lines defining each space being interrupted by the name of the day and the date applicable to such space. The calendar provides desired information in summary form concerning a plurality of single and/or continuing events in a given field of interest and which may occur concurrently and/or sequentially during the period of a particular month (or any part thereof). Such information may comprise the dates of starting and closing of the single and/or continuing events, the sites at which they are held, and resumes of what is to be exhibited or occurs; and such information, if the event continues over a plurality of days, may be provided in a continuous and repetitive form in each line extending through the spaces representing the days between the starting date and through the last date of the continuing event. The starting and closing dates are especially flagged.

The array of spaces is printed out on part of a sheet of paper to leave a free area adjacent the array. In this free area may be provided certain detailed information relating to the single and/or continuing events and/or sites described in the spaces constituting the array, and this information may be with references to abbreviations, acronyms or code symbols utilized in said spaces of the array.

6 Claims, 3 Drawing Figures

14a
14b
14c
(CLOSED FOR THE DAY)
(CLOSED FOR THE DAY)
SUNDAY
30TH
WORD ABBREVIATIONS
AND
BY
CONTINUES
DRAWING(S)
FOR
FROM
CAUCHE
NUMBER
OF
PAINTING(S)
PRINT(S)
RETROSPECTIVE
SPECIAL EVENT
SCULPTURE, SCULP OR SC
THE
TO
WATERCOLOR(S)
WITH
NEXT TO LAST DAY
LAST DAY OF EXHIB
OPENS
(CLOSED FOR THE DAY)
10
14
30
38
40
42
44
46
48
50

10
12
14
14a
14b
14c
14d
38
40
41
42
43
44
45
46
48
54
56
SUNDAY
MONDAY
TUESDAY
WED
2ND
3RD
4TH
9TH
10TH
11TH
1 PAULY STRAND RETAIL PAINTING LANDMARK
2 * * OPENS * *
3 * * OPENS * *
4 GERICAULT, PAINT'GS & DWGS, L.A.C.M.A.
(CLOSED FOR THE DAY)
GERICAULT, PAINT'GS & DWGS, L.A.C.M.A.
GERICA---AZ.
* * OPENS * *
(CLOSED FOR THE DAY)
(CLOSED FOR THE DAY)
GERICAULT, PAINT'GS & DWGS, L.A.C.M.A.
GERICAULT, PAINT'GS & DWGS, L.A.C.M.A.

EVENT CALENDAR

BACKGROUND OF THE INVENTION

1. Field of the Invention

This invention relates to calendars featuring descriptions of a plurality of single and/or continuing events in a given field and which may occur concurrently, in whole or in part, and/or sequentially during a given period of time, such as, for example, a month.

2. Description of the Prior Art

Almost since the time when block type calendars were first devised, people have utilized such calendars to indicate when certain events will occur, and if the events continue over a number of days, also to indicate that fact as well, Heretofore, however, such calendars have only been utilized to describe a single event or exhibition which may occur during any particular day or days; and where the event occurred over a number of days, previous calendars have utilized a format which repeated the entire entry on every day of the period during which the event occurred.

There has existed a need, however, which has not been satisfied by any prior art type calendars, for a calendar in a standard format which can bring together concurrently, and to present graphically, information as to the nature and periods of time during which they occur, of certain single and/or continuing events in a particular field, such as art, music, science, or business, in any geographical area, including that of the entire world. Such information may be particularly desired by an institution or individual which or who is interested in following closely single and/or continuing events in which it, he or she may be interested. For example, a patron of the arts may desire to plan trips around the country and even abroad in order to visit exhibitions of paintings or other works of art which exhibitions may be occurring in the geographical areas in which he or she plans to travel. Another example where such information could be utilized is where a buyer of a department store or other merchandiser may wish to visit trade shows either national, regional, or local for the purpose of ascertaining merchandise which is offered and which he or she may be interested in purchasing on behalf of his or her employer. Heretofore, no calendars have been devised in which information as to a number of events which may be occurring either simultaneously or overlappingly can be graphically presented as so occurring or overlapping.

Where only one or two events or exhibitions may be occurring, either simultaneously or overlappingly, featuring desired information concerning them on a conventional calendar might present some difficulty. However, in certain fields, such as the field of art, sometimes as many as 10 or 20 events, or even more, may be occurring during a particular monthly period, and overlappingly in whole or in part, or sequentially. To list and describe such a large number of single and/or continuing events and to place such information on a calendar of manageable and conveniently legible size, requires special organization.

Since one object of such a calendar is to place it in the hands of many individuals, the calendar must be made up and printed economically so that it can be delivered to subscribers at a minimum cost. This requirement cannot be met if the calendar must be printed by conventional typesetting methods. Nor can the cost be kept down if the information must be reinserted by individual typing for each new month.

It may thus be seen that no calendar has heretofore been devised which could satisfy the requirements and objectives of the present invention.

SUMMARY OF THE INVENTION

The present invention utilizes the conventional array of rectangular spaces representing the days of a month on a weekly basis, with Sundays on the left side and Saturdays on the right side of the array, but defines such spaces both vertically and horizontally by a series of dash lines spaced from each other so that they may be provided by a computer-operated printer. The horizontal dash lines are interrupted at the top of each thus-defined rectangular space to print out at least an abbreviation, and preferably the full name of the appropriate day and the date number.

On the left side of each Sunday space and on the right side of each Saturday space, the lines may be numbered or lettered in ordered sequence. On each line, starting with the first, is featured abbreviated and/or coded information concerning each particular or continuing event. Where the event continues over such number of days that the extent of the day spaces exceeds the extent of the abbreviated and/or coded information about the same then such information is repeated extending into all subsequent spaces representing days during which the continuing event occurs, through the last day thereof. The next to last day and last day of each continuing event are specially flagged by diagonal markings through the words describing the event.

The opening of each event or exhibition is also specially flagged by some means, such as bracketing the word "OPENS" with asterisks.

Where, as is often the case, the site at which a continuing event is being held, is closed for a day, that fact is so indicated and the line number may be placed on both side edges of the space which represents the closed day, so that when the information concerning the event again commences in the following space, it more easily may be related by that line number, to what had appeared in the previously open space.

The array of defined spaces is printed out on a sheet large enough to provide free areas adjacent, and preferably at the top and bottom of the array. When the first day of the month, or any part thereof, is not a Sunday and the month is not a 28-day February, certain of the free areas will be adjacent to one or more first and/or last day spaces for the month. In such free areas may be provided more detailed information concerning the sites mentioned in the calendar including abbreviations of the names of the sites and of words and coding used, the single and/or continuing events and their dates (including their traveling schedule), available catalogues, brochures, programs, and/or posters, special event references and any additional information which may be particularly helpful to the calendar user.

All of the foregoing information may be committed, as it is gathered, to a computer memory bank and, with the approach of each month, may readily be printed out in the calendar format of the present invention. Thus, events or exhibitions which continue from one month to another will be automatically included by the computer in the next month's calendar as continuations, and continuing events or exhibitions starting in the next month will be announced as opening. As events or exhibitions come to a close, such closures will be flagged.

Thus, a user may readily inspect a calendar of the present invention and select those events or exhibitions which he or she may desire to attend and make the most practical plans to attend the same to avoid conflicts, arrivals on days when the site is closed, and arrivals after an event or exhibition may have terminated. In addition, the subscriber will be able to procure and study in advance such publications as may be available. Moreover, all this information can be made available at a reasonable and relatively inexpensive subscription price.

BRIEF DESCRIPTION OF THE DRAWINGS

In the accompanying drawings.

DESCRIPTION OF THE PREFERRED EMBODIMENT

Figure 1:
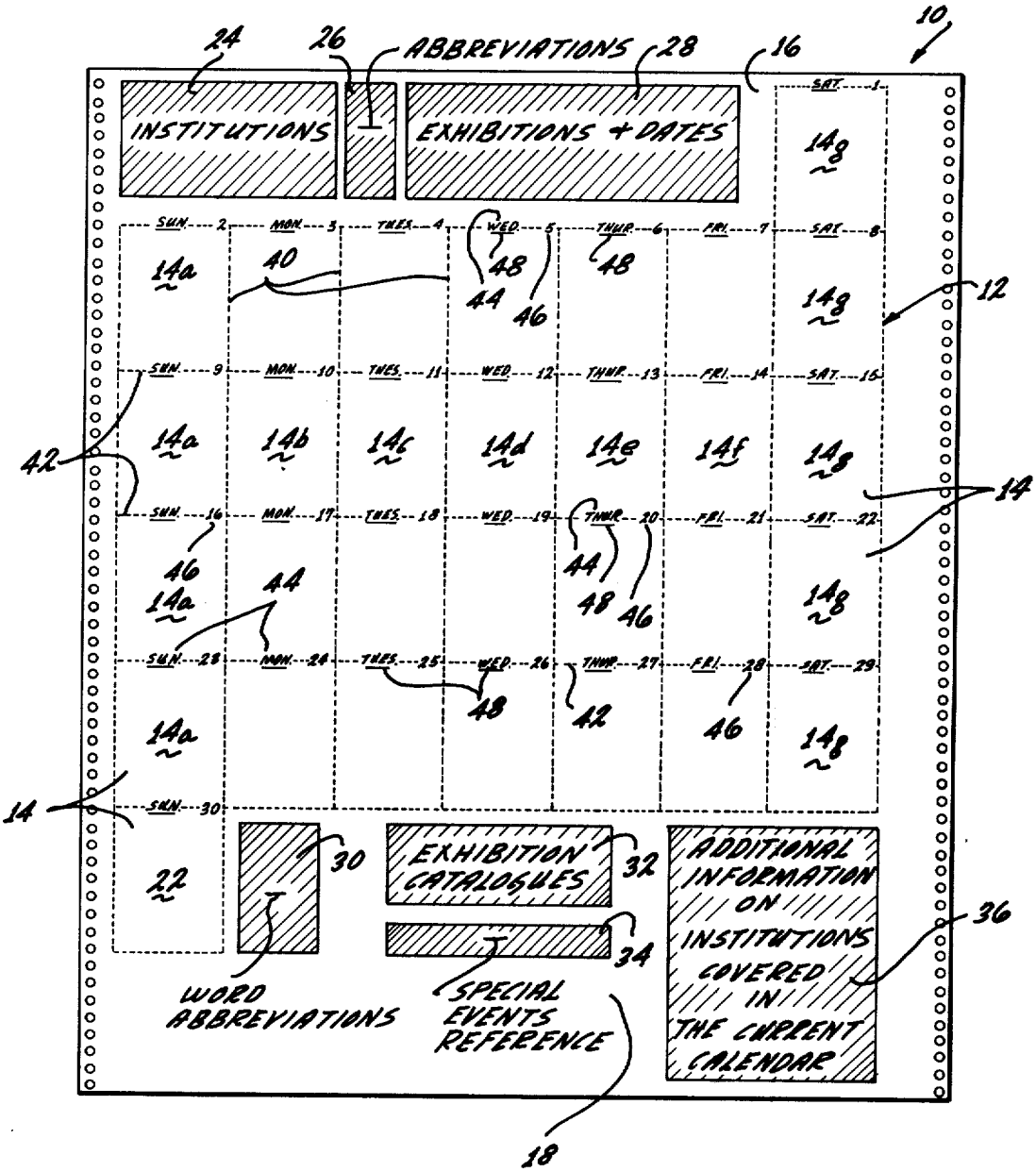
FIG. 1 is a plan view of a monthly version of the calendar of the present invention where the first day of a thirty-day month falls on a Saturday.

Referring to FIG. 1 of the drawings, there is provided on a sheet 10 a conventional calendar array 12 of defined spaces 14, which array 12, in the example illustrated represents a thirty-day month where the first day falls on a Saturday. With this particular array, there may be seen to exist free areas 16 and 18 which are above and below the array respectively, and also respectively are adjacent space **14*g* representing Saturday the 1st and the space 22, representing Sunday the 30th** of the month.

In the area 16 may be provided a listing 24 of all sites to be mentioned in the calendar of events, together with abbreviations 26 therefor. Also may be listed in area 16 the events 28 to be calendared, their travel schedules, and their dates as for example, "Western Art Show — 5/23 - 7/15".

Below the array 12 in the area 18 may be provided a listing 30 of word abbreviations and code symbols (See FIG. 2) utilized in the calendar, together with other information, such as available event publications 32, special event references 34 and additional information 36 on the sites listed at 24.

The array 12 of the day and date spaces 14 is defined by series of vertical dash lines 40 and horizontal dash lines 42, in each case spaced from each other. Such dash lines 40, 42 may be struck by a computer printer. As may be seen, however, the horizontal lines which define the top of each space 14 are interrupted by the appropriate day designation 44 and date number 46. The former may be underscored as at 48 for clarity.

Figure 2:
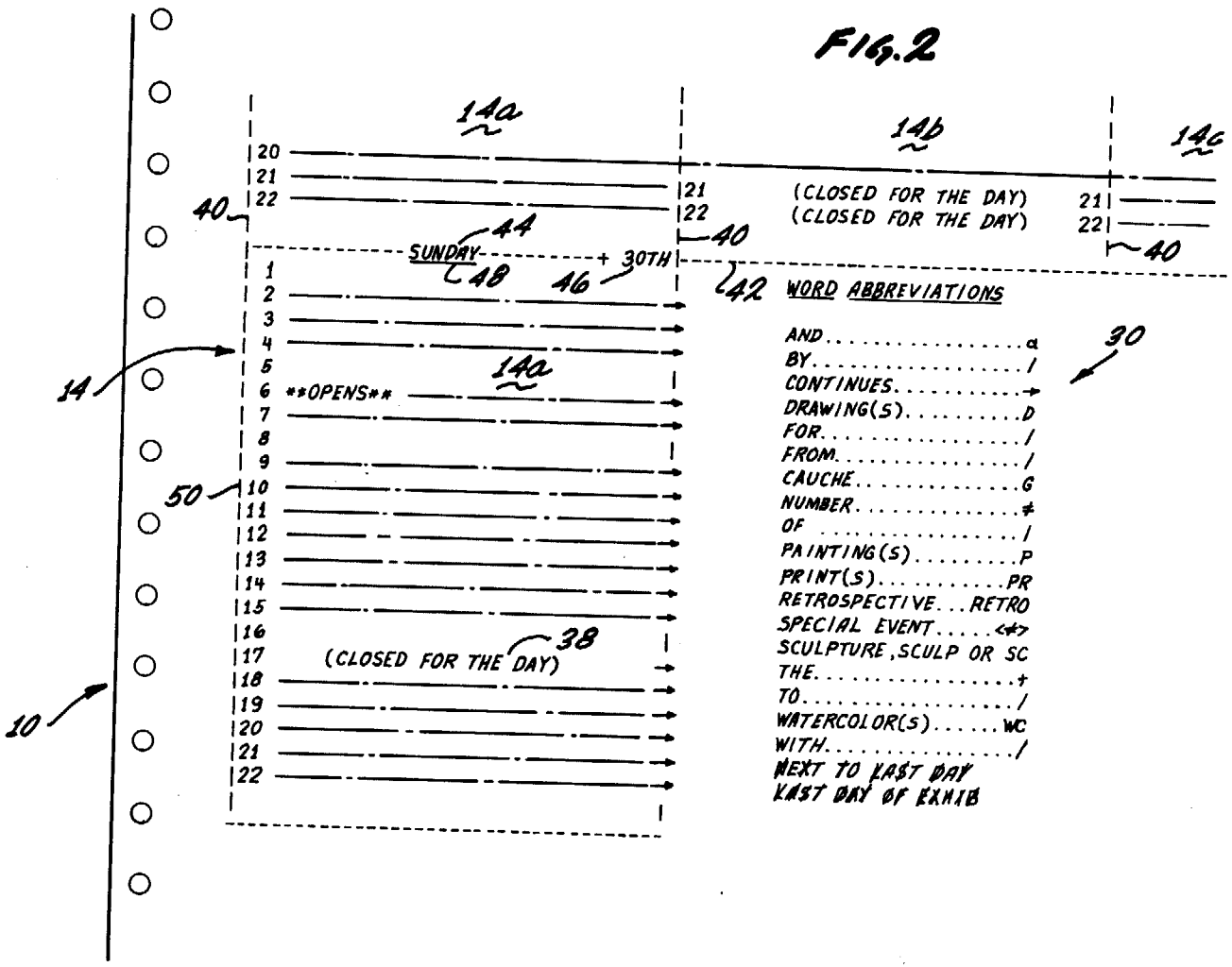
FIG. 2 is an enlargement of the lower left hand corner of FIG. 1.
Figure 3:
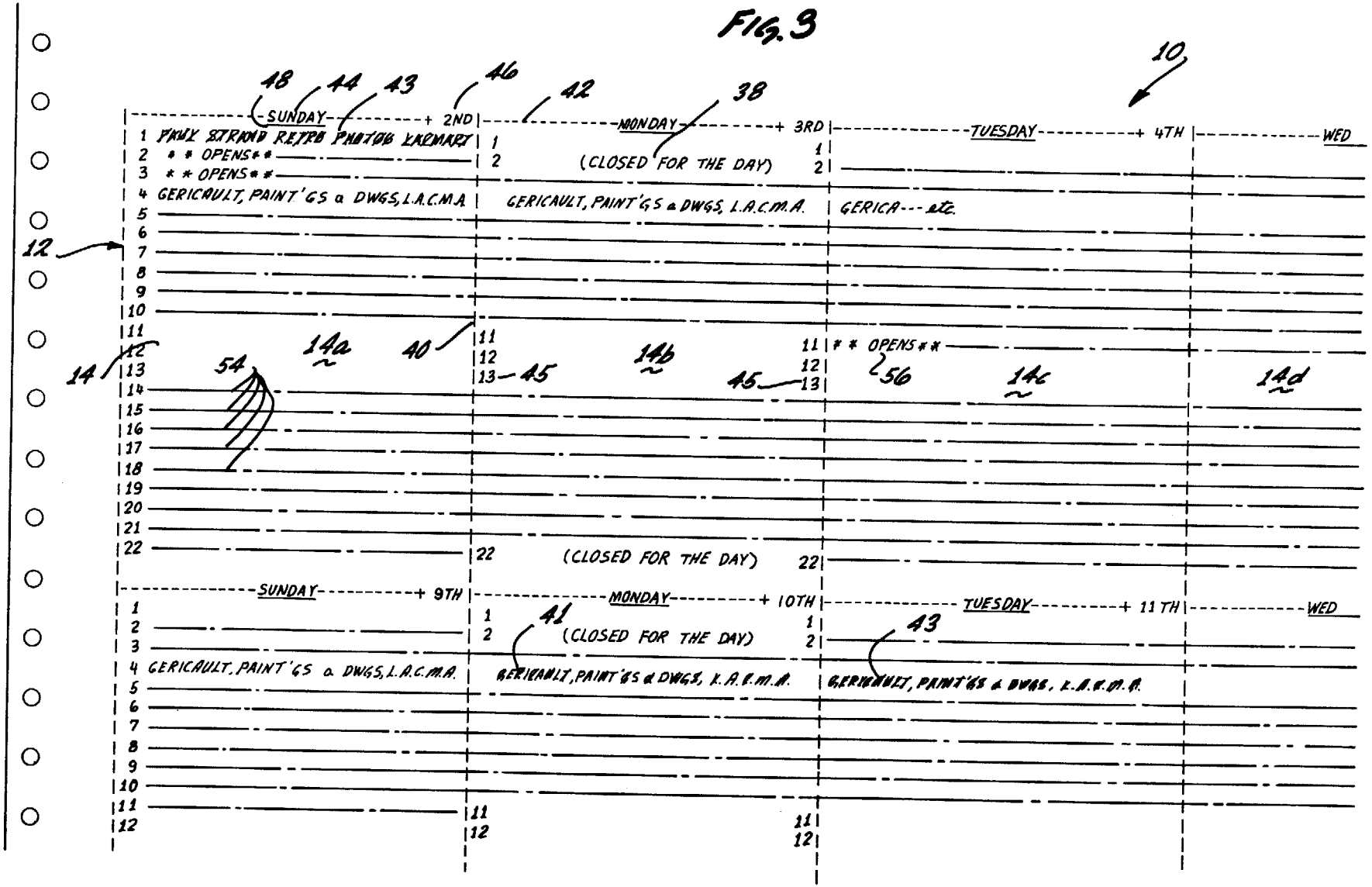
FIG. 3 is an enlargement of the spaces representing Sunday, Monday, Tuesday and half of Wednesday, the 2nd, 3rd, 4th, and 5th, and the upper half of the next row of spaces representing the 9th, 10th, 11th and half of the 12th of the month.

As may be seen in the enlargements of FIG. 2 and 3, the left edge 50 of each Sunday space 14 is provided with a sequence of line numbers 52 and the same numbers may also be provided on the right edge of each Saturday space **14*g*** (not shown).

When, as in line 4 of the top Sunday space **14*a*** in FIG. 3, an event described has continued from the preceding week and continues through the ensuing days of the week following such Sunday, a description

39, such as "GERICAULT, PAINT'GS & DWGS, L.A.C.M.A." (meaning, as explained in the line 28 in area 16, "GERICAULT, 124 PAINTINGS AND DRAWINGS, LOS ANGELES COUNTY MUSEUM OF ART" ) will start on the left side of the Sunday space **14*a* following the line number 52 and, if the event continues for a number of days, will be repeated through the vertical dash lines 40 defining the Sunday, Monday, Tuesday, etc. spaces 14*a*, 14*b*, 14*c*, etc. respectively, for the balance of the spaces 14*d*, 14*e*, 14*f*, and 14*g* for that week and all subsequent weeks until the event closes or a day occurs when the site at which the exhibition or event is being held may be closed. In the latter case, as shown at 38, the site's closure for the day is clearly flagged by the words "Closed for the Day" which are bracketed. As the event draws to a close, in order to flag the same, a diagonal strike-over on every other letter of the words describing the event is provided. In the following space, as shown at 43, the closing date is flagged and emphasized by providing a diagonal strike-over on each letter of the event description which appears on the last day space. Each of the lines 54 represents a description similar to that designated 39** and provided hereinabove.

If a continuing event should not commence until a day in the week following a Sunday, or if the site at which the event is being held should be closed on Monday, then, as shown at 45, the line number 52 for that event which appears on the left side of the Sunday space **14*a* may be repeated on both the left and right edges of the Monday space 14*b* for ease in following the line. Then, starting with the following Tuesday space 14*c***, the event description will reappear in the former instance, or appear, in the latter, and continue, and to the extent necessary, repetitively until its institution shall have a "closed" day or the event terminates, which facts will be indicated, in the same manner as described in the preceding paragraph.

Should any continuing event be terminated before the end of the period represented by the calendar spaces 38, the same line may be used again to provide information concerning other single and/or continuing events which may open on a day after the termination of the earlier single and/or continuing events.

The opening of single and/or continuing events will be especially flagged by the asterisked bracketed word OPENS, as shown at 56.

From the foregoing description of the calendar illustrated in the accompanying drawings, it may be seen that fairly full and accurate information will be provided with respect to a number of single and/or continuing events in any given field of interest where at least some of such single and/or continuing events may be held concurrently or for at least partially overlapping periods and others, sequentially; that all such information may be committed to a computer data bank and provided in the calendar format described through a computer print-out; and, even where many events are concurrently, described, the information with respect thereto may be easily read and important dates, such as openings and closings, readily noted.

I claim:

1. An event calendar, said calendar comprising:

A. a rectangular sheet of paper upon which are arranged rows, vertically aligned, of defined rectangular spaces, each representing one of the days in a given month, or part thereof, on a weekly basis in block form with the spaces representing Sundays disposed on the left side, and Saturdays, on the right side, of the array and the defined spaces representing each of the other five days of the week disposed in order horizontally between the Sunday and Saturday spaces in a conventional monthly calendar format; each of the rectangular spaces representing a Sunday having on its left side a sequence of designator numbers, one for each line from top to bottom of said space, one line or a portion thereof being provided for each event or exhibition to be described; there being provided on each said line commencing in the rectangular Sunday space in each row of spaces after the date when an event has opened, an abbreviated description of the event extending continuously on the same line in the remainder of the rectangular spaces in the same row and on a corresponding line in each subsequent row of spaces through the space representing the date when the event closes, and repetitively to the extent said abbreviated description does not extend through all of the last said spaces; and each space representing a day when a site, or event is not open being appropriately marked so to indicate such fact; said description of the event and the site at which it is held utilizing abbreviations, acronyms and/or code symbols; and B. at least one free area on said rectangular sheet outside of said array of spaces, but in the vicinity thereof, in which area information relating to events, and/or sites described in the spaces constituting said array, is further detailed with references to the abbreviations, acronyms or code symbols utilized in said spaces to describe the events and sites and the time periods during which they are open for attendance or closed.

2. The calendar as described in claim 1 wherein the rectangular spaces are defined both horizontally and vertically by marks regularly spaced from each other, but with the horizontal definition of each space being interrupted by the name of the day and the date applicable to such space.

3. The calendar as described in claim 1 wherein designator numbers corresponding to those provided on the left side of each Sunday space and on the same lines, are provided on the right side of the rectangular space in the same row of spaces representing a Saturday.

4. An event calendar, said calendar comprising:

A. a rectangular sheet of paper upon which are arranged rows, vertically aligned, of defined rectangular spaces, each representing one of the days in a given month or period thereof, on a weekly basis in block form with the spaces representing Sundays disposed on the left side, and Saturdays, on the right side, of the array and the defined spaces representing each of the other five days of the week disposed in order horizontally between the Sunday and Saturday spaces in a conventional monthly calendar format; each of the rectangular spaces representing a Sunday having on its left side a sequence of designator numbers, one for each line from top to bottom of said space, one line or a portion thereof being provided for each event to be described; there being provided on each said line in the rectangular space representing the date when an event opens, a flagging designation indicating such opening, followed by an abbreviated description of the event extending continuously on the same line in the remainder of the rectangular spaces in the same row on a corresponding line in each subsequent row of spaces through the space representing the date when the event closes and repetitively to the extent said abbreviated description does not extend through all of the last said spaces; and each space representing a day when a site or event is not open being appropriately marked so to indicate such fact; said description of the event and the site at which it is held utilizing abbreviations, acronyms and/or code symbols; and B. at least one free area on said rectangular sheet outside of said array of spaces, but in the vicinity thereof, in which area information relating to events, and/or sites described in the spaces constituting said array, is further detailed with references to the abbreviations, acronyms or code symbols utilized in said spaces to describe the events and sites and the time periods during which they are open for attendance or closed.

5. An event calendar, said calendar comprising:

A. a rectangular sheet of paper upon which are arranged rows, vertically aligned, of defined rectangular spaces, each representing one of the days in a given month or a part thereof, on a weekly basis in block form with the spaces representing Sundays disposed on the left side, and Saturdays, on the right side, of the array and the defined spaces representing each of the other five days of the week disposed in order horizontally between the Sunday and Saturday spaces in a conventional monthly calendar format; each of the rectangular spaces representing a Sunday having on its left side a sequence of designator numbers, one for each line from top to bottom of said space, one line or a portion thereof being provided for each event to be described; there being provided on each said line in the rectangular space representing the date when an event opens, a flagging designation indicating such opening, followed by an abbreviated description of the event extending continuously and repeatedly on the same line in the remainder of the rectangular spaces in the same row and on a corresponding line in each subsequent row through the space representing the date when the event closes, and repetitively to the extent said abbreviated description does not extend through all of the last said spaces; the space immediately preceding said closing date space being provided with a symbol indicating closure on the following day, and the next space being provided with a symbol of closure of the event; and each space representing a day when a site, or event is not open being appropriately marked so to indicate such fact; said description of the event and the site at which it is held utilizing abbreviations, acronyms and/or code symbols; and B. at least one free area on said rectangular sheet outside of said array of spaces, but in the vicinity thereof, in which area information relating to events, and/or sites described in the spaces constituting said array, is further detailed with references to the abbreviations, acronyms or code symbols utilized in said spaces to describe the events and sites and the time periods during which they are open for attendance or closed.

6. The calendar as described in claim 5 wherein designator numbers corresponding to those provided on the left side of each Sunday space and on the same lines, are provided on the right side of the rectangular space in the same row of spaces representing a Saturday.

* * * * *